United States Patent [19]

Dunn

[11] Patent Number: 5,042,657

[45] Date of Patent: Aug. 27, 1991

[54] ELONGATED TUBULAR CONTAINER FOR VENETIAN BLINDS

[75] Inventor: Jeffrey S. Dunn, Chester, N.J.

[73] Assignee: Multi-Wall Packaging Corporation, Irvington, N.J.

[21] Appl. No.: 577,197

[22] Filed: Sep. 4, 1990

[51] Int. Cl.[5] ..... B65D 85/00; B65D 5/42

[52] U.S. Cl. ..... 206/326; 206/526; 220/652; 229/115; 229/199

[58] Field of Search ..... 229/115, 199; 206/326, 206/525, 577, 526; 270/651, 652, 402

[56] References Cited

U.S. PATENT DOCUMENTS

| | | | |
|---|---|---|---|
| 1,833,419 | 11/1931 | Grossen | 229/115 X |
| 2,050,791 | 8/1936 | Graham | 229/199 X |
| 2,227,341 | 12/1940 | Greenwood | 229/115 X |
| 2,340,422 | 2/1944 | Okonski | 206/321 |
| 2,822,083 | 2/1958 | Horne et al. | 206/326 |
| 2,950,038 | 8/1960 | Rupp | 206/521 |
| 2,985,353 | 5/1961 | Force | 229/115 X |
| 3,199,765 | 8/1965 | Locke | 229/115 X |
| 3,244,348 | 4/1966 | Shaw . | |
| 3,368,736 | 2/1968 | McKellick | 229/199 |
| 3,482,760 | 12/1969 | Pascus et al. | 229/115 |
| 3,550,834 | 12/1920 | McCall | 229/115 |
| 3,756,497 | 9/1973 | Stewart | 229/115 |
| 3,891,136 | 6/1975 | Woeste | 229/115 |
| 4,172,522 | 10/1979 | Muller et al. | 229/115 X |
| 4,202,485 | 5/1980 | Fremion . | |
| 4,253,601 | 3/1981 | Kossoff | 229/115 |
| 4,281,788 | 8/1981 | Aeba | 229/115 |
| 4,607,784 | 8/1986 | Calabrere | 229/115 |
| 4,771,885 | 9/1988 | Linnemann | 206/386 |
| 4,771,893 | 9/1988 | Liebel | 206/326 X |
| 4,865,201 | 9/1989 | Liebel | 206/326 X |

FOREIGN PATENT DOCUMENTS

| | | | |
|---|---|---|---|
| 2641521 | 7/1990 | France | 229/199 |

*Primary Examiner*—Bryon P. Gehman

*Attorney, Agent, or Firm*—Barlow & Barlow, Ltd.

[57] ABSTRACT

Container for Venetian blind including a tube of corrugated board of triangular cross-section and a reinforcing element of angular configuration made of chip board.

2 Claims, 1 Drawing Sheet

ELONGATED TUBULAR CONTAINER FOR VENETIAN BLINDS

BACKGROUND OF THE INVENTION

There are many situations in the packaging industry where it is necessary to ship and store articles that are very long and which will be damaged by bending. This is particularly true in the case of long Venetian blinds. Since these blinds include a metal control box, there is no problem of bending or breakage when the lengths are small. When, however, the Venetian blind is long, i.e., in the order of 50 inches, the conventional containers are not adequate to prevent damage.

In the past, it has been common to package items, such as blinds, in tubular containers having a triangular cross-sectional shape, the container usually being made of corrugated board. Such containers are shown and described in the patents of GREENWOOD No. 2,227,341; LOCKE No. 3,199,765; SHAW No. 3,244,348; PASCUS et al No. 3,482,760; McCALL No. 3,550,834; STEWART No. 3,756,497; WOESTE No. 3,891,136; MULLER et al No. 4,172,522; PREMION No. 4,202,485; and KOSSOFF No. 4,253,601.

The patent of HORNE et al No. 2,822,083 shows a blind that is packaged by use of a strap. Other variations of the "wrap around" method of packaging are shown in the patents of OKONSKI No. 2,340,422 and KALANJUK et al No. 4,880,944. In addition, several patents show the use of corrugated board for reinforcement, including the patents of RUPP No. 2,950,038; LIEBEL No. 4,771,893; and LIEBEL No. 4,865,201.

None of these constructions lend themselves to the packaging of very long Venetian blinds, because they do not provide adequate protection against bending. Furthermore, they tend to be expensive and difficult to assemble.

These and other difficulties experienced with the prior art dvices have been obviated in a novel manner by the present invention.

It is, therefore, an outstanding object of the invention to provide a container for elongated articles which container is very rigid and which inhibits bending.

Another object of this invention is the provision of a container especially adapted to ship and store a Venetian blind and to prevent damage to it.

A further object of the instant invention is the provision of a triangular wrap-around container, which is simple and rugged in design, which is inexpensive to manufacture, and which is capable of a long life of useful sevice.

It is another object of the instant invention to provide a container that is particularly adapted to solve the problems encountered in the shipment of a long Venetian blind.

A still further object of the invention is the provision of a container which presents its greatest resistance to bending in the plane of the least resistance to bending of an article contained therein.

With these and objects in view, as will be apparent to those skilled in the art, the invention resides in the combination of parts set forth in the specification and covered by the claims appended hereto.

SUMMARY OF THE INVENTION

In general, the present invention relates to a container for an elongated product, the container having an external enclosure consisting of three rectangular panels of corrugated board hinged together and fastened together to form a tube with a cross-section in the shape of a triangle. The container also has a reinforcement element consisting of two rectangular panels of chip board hinged together along a longitudinal line parallel to one of the hinges of the external enclosure, whereby the elongated product is supported against bending.

More specifically, the invention relates to a package for the shipment and storage of a very long Venetian blind having a control box and a plurality of nesting slats, The package includes an external enclosure formed of corrugated board into a tube with a triangular cross-sectional shape, the control box having a rectangular cross-sectional shape that has two spaced, parallel long sides joined by two shorter sides, the slats being nested on one of the long sides, the box being located with the other of the long sides lying against one of the sides of the triangular closure, with the nested slats extending in the direction of the apex of the triangle that is opposite the said one of the sides of the enclosure. A tent-like reinforcement element is provided formed of chip board with its peak located adjacent the said apex of the triangle, so that the reinforcement element lies in the direction of the least bendng strength of the control box and slats.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
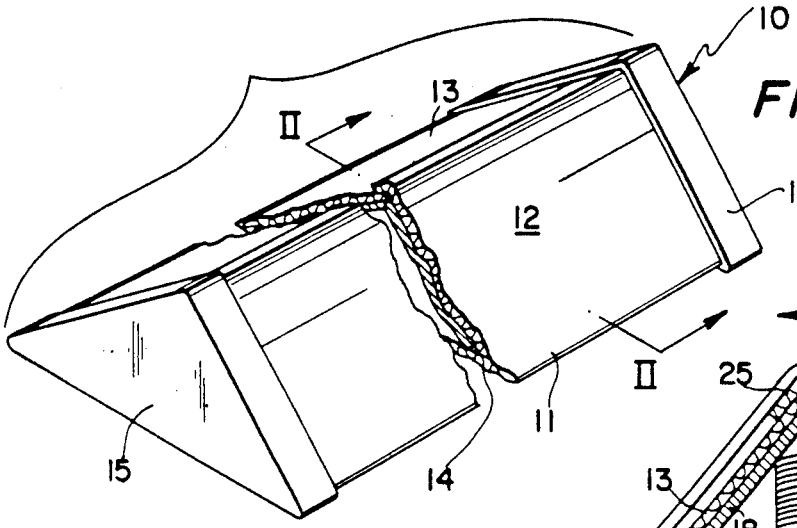
FIG. 1 is a perspective view of a container incorporating the principles of the present invention.

Referring first to FIG. 1, which best shows the general features of the invention, the container, indicated generally by the refence numeral 10, includes an elongated external enclosure 11 consisting of three rectangular panels 12, 13, and 14 of corrugated board that are hinged together and fastened to form a tube with a cross-sectional shape in the form of a triangle. End caps 15 and 16 are carried on the ends of the enclosure. In the illustration, the proportions are exaggerated for clearness, but it will be understood that the enclosure is very long and can receive a Venetian blind that is 50 inches long, for instance.

Figure 2:
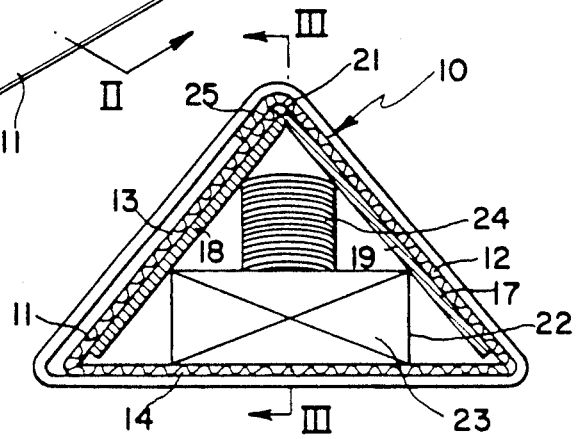
FIG. 2 is a transverse sectional view of the container, taken on the line II—II of FIG. 1.
Figure 3:
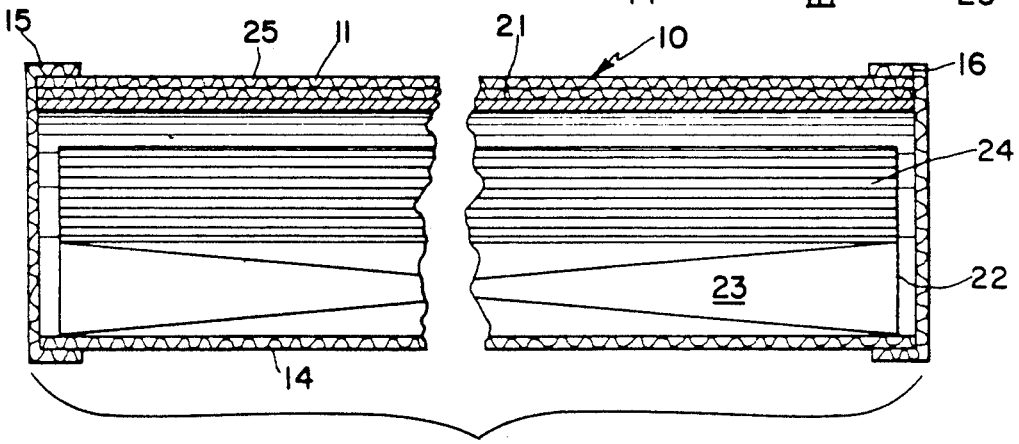
FIG. 3 is a longitudinal sectional view of the container, taken on the line III—III of FIG. 2.
Figure 4:
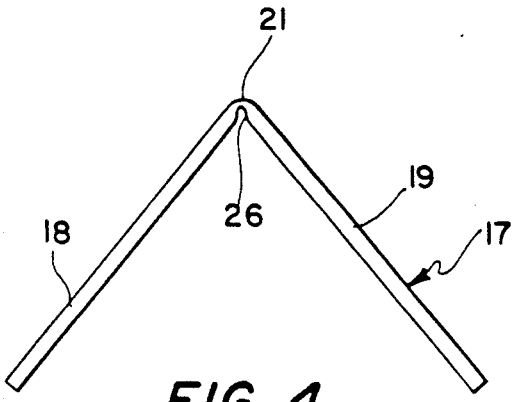
FIG. 4 is an end view of a reinforcing element forming part of the invention.

FIGS. 2 and 3 demonstrate further details of the invention, including the inclusion in the external enclosure 11 of a reinforcing element 17 that consists of two rectangular panels 18 and 19 of rigid chip board . The panels are hinged together along a longitudinal line 21 which extends parallel to one of the hinges of the external closure. This allows an elongated product, such as the Venetian blind 22 contained within the container to be supported against bending. The blind consists of a control box 23 and nested slats 24.

The three panels of the enclosure consist of an elongated central panel 14 with elongated end panels 12 and 13 hinged to its longitudinal sides. The end panels have longitudinal sides that come together at one apex of the triangle. The end panel 12 has a flap 25 that overlies the other end panel 13 and is cemented thereto. The hinge line 21 of the reinforcing element 17 is located at the above-described apex of the triangle.

Figure 5:
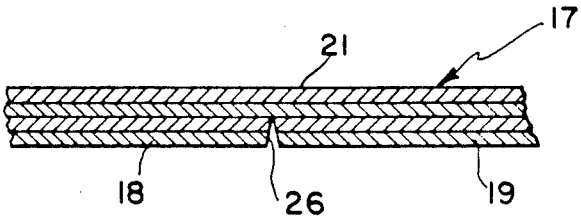
FIG. 5 is a somewhat enlarged transverse sectional view of the reinforcing element.

The reinforcing element 17, as has been stated, is formed of chip board, which, as is evident in FIG. 5, is made up of a plurality of laminations. The element is provided with a notch 26 which cuts through some of the laminations to facilitate the hinging about the line 21.

The operation and the advantages of the invention will now be readily understood in view of the above description. The combination of the external enclosure 11, the reinforcing element 17, and the Venetian blind 22 results in a package that is particularly useful. The fact that the control box 23 of the blind lies with one of its long sides pressing against the central panel 14 of the enclosure means that the nested slats 24 extend in the direction of the apex of the triangle that is opposite the panel 14 and the hinge line 21 of the reinforcing element lies against that same apex. This means that the reinforcement element (with its strong chip board and with its peak adjacent the said apex of the enclosure lies) in the direction of the least bending strength of the control box 23 and the slats 24. In other words, the reinforcing element is located precisely in the position necessary to augment the strength of the Venetian blind.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Package for the shipment and storage of a very long Venetian blind having a control box and a plurality of nesting slats, comprising (a) an external enclosure of corrugated board formed into a tube with panels forming a triangular cross-sectional shape, the control box having a rectangular cross-sectional shape that has two spaced, parallel long sides joined by two short sides, the slats being nested on one of the long sides, the box being located within the enclosure with the other of the long sides lying against one of the panels of the external enclosure, with the nested slats extending in the direction of a junction of the panels that lies opposite the said one of the panels of the enclosure, and (b) an angular reinforcement element formed of chip board located in the enclosure with its vertex adjacent the said junction of the panels, so that the reinforcement element extends in the direction of the least bending strength of the control box and slats.

2. A container having an elongated product therein, the container having substantially greater bending strength in one direction than in any other, comprising (a) an external enclosure consisting of three rectangular panels of corrugated board hinged together and fastened together to form a tube with a cross-section in the shape of a triangle, the three panels of the external enclosure consist of an elongated central panel with an elongated end panel hinged to each of its longitudinal sides, the end panels having longitudinal sides that come together at one apex of the triangle, one of the end panels having a flap that overlies the other end panel and is cemented thereto, and (b) a reinforcement element consisting of two rectangular panels of rigid chip board, the chip board panels being hinged together along a longitudinal line parallel to one of the hinges of the external enclosure and parallel to the said one direction of the product, whereby the elongated product is supported against bending in the said one direction, the chip board being formed of a lamination of several layers and the hinge joining the two said panels of the reinforcing element being formed by cutting notch through less than all the layers.

* * * * *